US006214502B1

(12) United States Patent
Srinivasan et al.

(10) Patent No.: US 6,214,502 B1
(45) **Date of Patent: *Apr. 10, 2001**

(54) CHARGE GENERATION LAYERS COMPRISING BINDER BLENDS AND PHOTOCONDUCTORS INCLUDING THE SAME

(75) Inventors: Kasturei Rangan Srinivasan, Longmont; Ronald Harold Levin, Boulder; Garry D. Hinch, Superior; Gregory Walter Haggquist, Longmont, all of CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/535,830

(22) Filed: Mar. 28, 2000

Related U.S. Application Data

(63) Continuation-in-part of application No. 09/120,057, filed on Jul. 21, 1998, now Pat. No. 6,042,980.

(51) Int. Cl.[7] ..... G03G 5/047

(52) U.S. Cl. ..... 430/58.4; 430/59.1; 430/59.4; 430/59.5; 430/96; 430/58.8

(58) Field of Search ..... 430/58.4, 58.8, 430/59.1, 59.4, 59.5, 96

(56) References Cited

U.S. PATENT DOCUMENTS

| | | | | |
|---|---|---|---|---|
| 3,396,016 | | 8/1968 | Olson | 430/96 |
| 3,493,369 | | 2/1970 | Busch et al. | 430/63 |
| 4,218,528 | | 8/1980 | Shimada et al. | 430/76 |
| 4,748,099 | * | 5/1988 | Shimada et al. | 430/96 |
| 4,788,118 | | 11/1988 | Takaoka et al. | 430/49 |
| 4,933,248 | | 6/1990 | Lind et al. | 430/83 |
| 5,320,923 | | 6/1994 | Nguyen | 430/78 |
| 5,350,655 | | 9/1994 | Oshiba et al. | 430/78 |
| 5,750,300 | | 5/1998 | Nguyen | 430/78 |
| 5,994,014 | | 11/1999 | Hinch et al. | 430/59.6 |
| 6,001,523 | | 12/1999 | Kemmesat et al. | 430/96 |
| 6,033,816 | * | 3/2000 | Luo et al. | 430/96 |
| 6,042,980 | * | 3/2000 | Kierstein et al. | 430/58.4 |

OTHER PUBLICATIONS

Abstract from Chemical Abstracts Plus No. JP 09096924 A2.
Abstract from Chemical Abstracts Plus No. JP 06308774 A2.
Abstract from Chemical Abstracts Plus No. JP 04273247 A2.
Abstract from Chemical Abstracts Plus No. JP 03012656 A2.
Abstract from Chemical Abstracts Plus No. DE 3800617 A1.
Abstract from Chemical Abstracts Plus No. JP 49066580.
Abstract from Chemical Abstracts Plus No. DE 2327661.
Abstract from Chemical Abstracts for Proc. SPIE–Int. Soc. Opt. Eng. (1996), 208–215.
Abstract from Chemical Abstracts for J. Vac. Sci.Technol., B. (1990), 8(6), 1441–6.
Abstract from Chemical Abstracts for Can. J. Chem. (1985), 63(1), 153–62.
Abstract from Derwent Database No. DE 4446409 A.
Abstract from Derwent Database No. De 4406075 A.
Abstract from Derwent Database No. EP 609511 A.
Abstract from Derwent Database No. US 5110700 A.
Abstract from Derwent Database No. JP 03294863 A.
Abstract from Derwent Database No. JP 03293674 A.
Abstract from Derwent Database No. JP 03179362 A.
Abstract from Derwent Database No. JP 03166556 A.
Abstract from Derwent Database No. JP 03166555 A.
Abstract from Derwent Database No. EP 324180 A.
Abstract from Derwent Database No. JP 01099057 A.
Abstract from Derwent Database No. DE 3739218 A.
Abstract from Derwent Database No. JP 62217256 A.
Abstract from Derwent Database No. Jp 62136664 A.
Abstract from Derwent Database No. JP 62098360 A.
Abstract from Derwent Database No. DE 3629445 A.
Abstract from Derwent Database No. DE 3513747 A.
Abstract from Derwent Database No. EP 194624 A.
Abstract from Derwent Database No. JP 61020048 A.
Abstract from Derwent Database No. JP 60225856 A.
Abstract from Derwent Database No. DE 3428407 A.
Abstract from Derwent Database No. DE 3313798 A.
Abstract from Derwent Database No. DE 3340149 A.
Abstract from Derwent Database No. DE 3300244 A.
Abstract from Derwent Database No. JP 56074257 A.
Abstract from Derwent Database No. JP 50084242 A.
Abstract from Derwent Database No. JP 50036130 A.
Abstract from Derwent Database No. JP 69028036 B.
Abstract from Derwent Database No. EP 889369 A.
Abstract from Derwent Database No. TW 340915 A.
Abstract from Derwent Database No. US 5728499 A.
Abstract from Derwent Database No. GB 2316769 A.
Abstract from Derwent Database No. JP 09311504 A.
Abstract from Derwent Database No. BE 895377 A.
Absrtact from Derwent Database No. JP 50036130 A.
Abstract from Derwent Database No. JP 67001108 B.
Abstract from Derwent Database No. NL 6903107 A.
Abstract from Derwent Database No. NL 136052 B.

* cited by examiner

*Primary Examiner*—Roland Martin
(74) *Attorney, Agent, or Firm*—John A. Brady

(57) ABSTRACT

Charge generation layers comprise a charge generation compound and a binder which comprises polyvinylbutyral and phenolic resol. Dual layer photoconductors comprise the charge generation layer in combination with a substrate and a charge transport layer, in which the charge generation layer comprises a charge generation compound and a binder which comprises polyvinylbutyral and phenolic resol. Dual layer photoconductors comprise the charge generation layer in combination with a substrate and a charge transport layer, in which the charge generation layer comprises a charge generation compound and a binder which comprises polyvinylbutyral and a resin selected from the group consisting of phenol novolac and polyhydroxystyrene.

35 Claims, No Drawings

CHARGE GENERATION LAYERS COMPRISING BINDER BLENDS AND PHOTOCONDUCTORS INCLUDING THE SAME

RELATED APPLICATION

This application is continuation-in-part of application Ser. No. 09/120,057 filed Jul. 21, 1998, now U.S. Pat. No. 6,042,980.

FIELD OF THE INVENTION

The present invention is directed to charge generation layers which comprise a charge generation compound and a binder, wherein the binder comprises polyvinylbutyral and a resin selected from the group consisting of phenolic resol, phenolic novolac and polyhydroxystyrene. The invention is also directed to photoconductors including such charge generation layers

BACKGROUND OF THE INVENTION

In electrophotography, a latent image is created on the surface of an image member which is a photoconducting material by first uniformly charging the surface and selectively exposing areas of the surface to light. A difference in electrostatic charge density is created between those areas on the surface which are exposed to light and those areas on the surface which are not exposed to light. The latent electrostatic image is developed into a visible image by electrostatic toners. The toners are selectively attracted to either the exposed or unexposed portions of the photoconductor surface, depending on the relative electrostatic charges on the photoconductor surface, the development electrode and the toner. Electrophotographic photoconductors may be a single layer or a laminate formed from two or more layers (multi-layer type and configuration). Typically, a dual layer eiectrophotographic photoconductor comprises a substrate such as a metal ground plane member on which a charge generation layer (CGL) and a charge transport layer (CTL) are coated. The charge transport layer contains a charge transport material which comprises a hole transport material or an electron transport material. For simplicity, the following discussions herein are directed to the use of a charge transport layer which comprises a hole transport material as a charge transport compound. One skilled in the art will appreciate that if the charge transport layer contains an electron transport material rather than the hole transport material, the charge placed on the photoconductor surface will be opposite that described herein.

When the charge transport layer containing a hole transport material is formed on the charge generation layer, a negative charge is typically placed on the photoconductor surface. Conversely, when the charge generation layer is formed on the charge transport layer, a positive charge is typically placed on the photoconductor surface Conventionally, the charge generation layer comprises a charge generation compound or molecule alone and/or in combination with a binder. A charge transport layer typically comprises a polymeric binder containing the charge transport compound or molecule The charge generation compounds within the charge generation layer are sensitive to image-forming radiation and photogenerate electron hole pairs therein as a result of absorbing such radiation. The charge transport layer is usually non-absorbent of the image-forming radiation and the charge transport compounds serve to transport holes to the surface of the negatively charged photoconductors. Photoconductors of this type are disclosed in the Adley et al U.S. Pat. No 5,130,215 and the Balthis et al U.S. Pat. No. 5,545,499.

Typically, the charge generation layer comprises a pigment or dye (phthalocyanines, azo compounds, squaraines, etc.), with or without a polymeric binder. Since the pigment or dye in the charge generation layer typically does not have the capability of binding or adhering effectively to a metal substrate, the polymer binder is usually inert to the electrophotographic process, but forms a stable dispersion with the pigment/dye and has good adhesive properties to the metal substrate. The electrical sensitivity associated with the charge generation layer can be affected by the nature of polymeric binder used. The polymeric binder, while forming a good dispersion, should have a greater interaction with the metal substrate rather than the pigment.

Similarly, the charge transport layer typically consists of a charge transport molecule (CTM), typically selected from arylamines, hydrazones, stilbenes, pyrazolines, and other known in the art in a polymeric binder The polymeric binder is typically a polycarbonate such as polycarbonate-A, polycarbonate-Z, etc. which provides good mechanical properties to the photoconductor. Photoconductors of this type are disclosed in the Kemmesat et al U.S. Pat. No. 6,001,523.

The photoconductor (conventionally in drum, web or belt form) is often subjected to several modes of abrasion by paper, cleaner, toner, end-seals, and the like. Therefore, it is imperative that the wear on the photoconductor be minimal for the photoconductor to have an extended long life in a printer cartridge. Increased wear on a photoconductor surface may lead to arcing of the charge roll, increased fatigue, scratches on the paper area, delamination, and the like, resulting in defects and decreased photoconductor life in the cartridge.

One approach for reducing photoconductor wear is the addition of materials to the photoconductor formulation that will either reduce the friction between the photoconductor and the other parts of the electrophotographic engine; increase the hardness of the formulation to enhance its wear resistance; or both. The use of silicon microspheres in the charge transport layer has been found to effectively reduce wear in photoconductors. Photoconductors of this type are disclosed in the Hinch et al U.S. Pat. No. 5,994,014. The use of polycarbonate-Z has also been known to exhibit improved wear resistance over polycarbonate-A. In addition, the use of polymeric blends, overcoats, organic additives (fluoropolymers, silicone oils, etc.), and inorganic additives have been known to improve the wear on the photoconductor surface. These approaches have varying effects on photoelectric properties of the photoconductors.

It may also be desirable to improve the sensitivity of the CGL in a photoconductor. Sensitivity may be improved by the use of certain pigments (e.g. Type-IV titanyt phthalocyanine instead of Type-I titanyl phthalocyanine or squarylium pigment), increasing the pigment concentration with respect to the polymeric binder, or through the use of polymeric blends in the charge generation layer.

As such, there is a continuing need for photoconductors exhibiting increased photoconductor sensitivity and enhanced resistance to wear.

SUMMARY OF THE INVENTION

Accordingly, it is the object of the present invention to provide novel photoconductors and/or novel charge generation layers which overcome one or more disadvantages of the prior art. It is a more specific object of the invention to provide charge generation layers which improve electrical sensitivity and/or improve the wear resistance of photoconductors.

These and additional objects and advantages are provided by the charge generation layers of the present invention and photoconductors including the same.

In one aspect of the present invention, the charge generation layer comprises a charge generation compound and a polymeric binder, wherein the polymeric binder comprises polyvinylbutyral and a phenolic resol. Another embodiment of the present invention is directed to a photoconductor comprising a substrate, a charge generation layer and a charge transport layer, wherein the charge generation layer comprises a charge generation compound and a binder, and further wherein the binder comprises polyvinylbutyral and a phenolic resol. Yet another embodiment of the present invention is directed to a photoconductor comprising a substrate, a charge generation layer and a charge transport layer, wherein the charge generation layer comprises a phthalocyanine charge generation compound and a binder, and further wherein the binder comprises polyvinylbutyral and a resin selected from the group consisting of a phenolic novolac and a polyhydroxystyrene.

These and additional objects and advantages will be more readily apparent in view of the following detailed description.

DETAILED DESCRIPTION

The charge generation layers according to the present invention are suitable for use in dual layer photoconductors. Such photoconductors generally comprise a substrate, a charge generation layer and a charge transport layer. While various embodiments of the invention disclosed herein refer to the charge generation layer being formed on the substrate, with the charge transport layer formed on the charge generation layer, it is equally within the scope of the present invention for the charge transport layer to be formed on the substrate with the charge generation layer formed on the charge transport layer.

The present invention is directed to charge generation layers containing a charge generation compound and a binder In one embodiment, the binder comprises polyvinylbutyral and a resin selected from the group consisting of phenolic novolac and polyhydroxystyrene. In another embodiment of the present invention, the binder comprises polyvinylbutyral and phenolic resol. Polyvinylbutyral polymers are well known in the art and are commercially available from various sources. These polymers are typically made by condensing polyvinyl alcohol with butyraldehyde in the presence of an acid catalyst, for example sulfuric acid, and contain a repeating unit of formula (II):

(II)

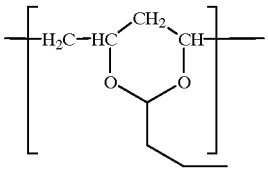

Typically, the polyvinylbutyral polymer will have a number average molecular weight of from about 20,000 to about 300,000.

Phenolic novolac resins are also well known in the art, are commercially available, and typically comprise a repeating unit of the following formula (V):

(V)

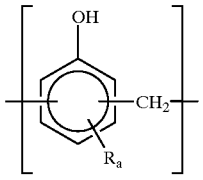

wherein R comprises a $C_{1-8}$ alkyl group and a is from 0 to 3. Additionally, phenolic novolac resins in which the hydroxy group is converted to an epoxide or substituted epoxide group, commonly referred to as an epoxy novolac, are included within the scope of the phenolic resins suitable for use in the blends of the present invention. The phenolic novolac resins typically have a number average molecular weight of at least about 600.

Polyhydroxystyrenes are typically of the following formula (VI):

(VI)

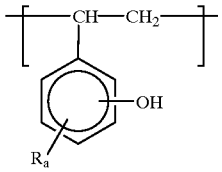

wherein R comprises a $C_{1-8}$ alkyl group and a is from 0 to 3. Polyhydroxystyrene novolacs are included within the scope of the polyhydroxystyrenes suitable for use in the present blends. Typically, the polyhydroxystyrenes will have a number average molecular weight of from about 4,000 to about 20,000.

Finally, the phenolic resols are typically of the following formula (VII):

(VII)

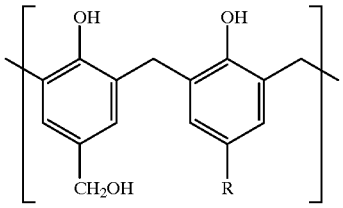

wherein R comprises a $C_{1-8}$ alkyl group. Additionally, phenolic resol resins in which the hydroxy group is converted to an epoxide or substituted epoxide group are included within the scope of the phenolic resol resins suitable for use in the blends of the present invention. The phenolic resol resins typically have a number average molecular weight of at least about 500.

The charge generation layers may comprise the charge generation compound and the binder in amounts conventionally used in the art. Typically, the charge generation layer comprises from about 5 to about 80 weight percent of the charge generation compound, preferably comprising from about 10 to about 55 weight percent of the charge generation compound, and more preferably comprising from about 15 to about 55 weight percent of the charge generation compound, and may comprise from about 20 to about 95 weight percent of the binder, preferably comprising from about 45 to about 90 weight percent of the binder, and more preferably comprising from about 45 to about 85 weight percent of the binder, all weight percentages being based on the weight of the charge generation layer. The charge generation layers may further contain additional conventional additives known in the art for use in charge generation layers.

In additional embodiments, the binder of the charge generation layer comprises polyvinylbutyral and phenolic resol in a weight ratio of from about 90:10 to about 10:90; and more preferably from about 90:10 to about 50:50. Preferably, the phenolic resol has an average molecular weight of at least about 500.

As set forth above, the charge generation layer according to the present invention comprises a binder and a charge generation compound. Various organic and inorganic charge generation compounds are known in the art, any of which are suitable for use in the charge generation layers of the present invention. One type of charge generation compound which is particularly suitable for use in the charge generation layers of the present invention comprises squarylium-based pigments, including squaraines. Squarylium pigments may be prepared by an acid route such as that described in U.S. Pat. Nos. 3,617,270, 3,824,099, 4,175,956, 4,486,520 and 4,508,803, which employs simple procedures and apparatus, has a short reaction time and is high in yield. The squarylium pigment is therefore very inexpensive and is easily available.

Preferred squarylium pigments suitable for use in the present invention may be represented by the structural formula (I)

I

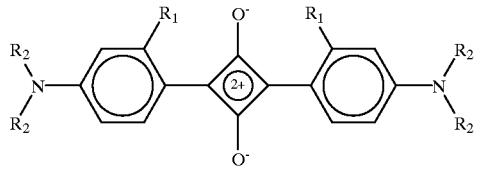

wherein $R_1$ represents hydroxy, hydrogen or $C_{1-5}$ alkyl, preferably hydroxy, hydrogen or methyl, and each $R_2$ individually represents $C_{1-5}$ alkyl or hydrogen. In a further preferred embodiment, the pigment comprises a hydroxy squaraine pigment wherein each $R_1$ in the formula (I) set forth above comprises hydroxy.

Another type of pigment which is particularly suitable for use in the charge generation layers of the present invention comprises the phthalocyanine-based compounds. Suitable phthalocyanine compounds include both metal-free forms such as the X-form metal-free phthalocyanines and the metal-containing phthalocyanines. In a preferred embodiment, the phthalocyanine charge generation compound may comprise a metal-containing phthalocyanine wherein the metal is a transition metal or a group IIIA metal. Of these metal-containing phthalocyanine charge generation compounds, those containing a transition metal such as copper, titanium or manganese or containing aluminum as a group IIIA metal are preferred. These metal-containing phthalocyanine charge generation compounds may further include oxy, thiol or dihalo substitution. Titanium-containing phthalocyanines as disclosed in U.S. Pats. Nos. 4,664,997, 4,725,519 and 4,777,251, including oxo-titanyl phthalocyanines, and various polymorphs thereof, for example type IV polymorphs, and derivatives thereof, for example halogen-substituted derivatives such as chlorotitanyl phthalocyanines, are suitable for use in the charge generation layers of the present invention.

The present invention is also directed towards photoconductors comprising an electrically conductive substrate, a charge generation layer and a charge transport layer. In one embodiment, the charge generation layer comprises a binder and a charge generation compound, wherein the binder comprises polyvinylbutyral and a phenolic resol. In another embodiment, the charge generation layer comprises a binder and a phthalocyanine charge generation compound, wherein the binder comprises polyvinylbutyral and a resin selected from the group consisting of a phenolic novolac and a polyhydroxystyrene.

In more specific embodiments of the present invention, the binder of the charge generation layer comprises polyvinylbutyral and polyhydroxystyrene in a weight ratio of from about 97:3 to about 5:95; and more preferably from about 97:3 to about 60:40. Preferably, the polyhydroxystyrene has a molecular weight average of from about 500 to about 5,000. In other more specific embodiments, the binder of the charge generation layer of the photoconductor comprises polyvinylbutyral and phenolic novolac in a weight ratio of from about 75:25 to about 25:75. Preferably, the phenolic novolac has an average molecular weight of at least about 400.

The charge transport layer of the photoconductor comprises a charge transport compound and a binder. Typically, the binder is polymeric and may comprise, but is not limited to, vinyl polymers such as polyvinylchloride, polyvinylbutyral, polyvinylacetate, styrene polymers and copolymers of the vinyl polymers, acrylic acid and acrylic polymers and copolymers, polycarbonate polymers and copolymers, including polycarbonate-A, which is derived from bisphenol-A, polycarbonate-Z, which is derived from cyclohexylidene bisphenol, polycarbonate-C, which is derived from methylbisphenol-A, polyesters, alkyd resin, polyamides, polyurethanes, epoxy resins or mixtures thereof and the like.

Conventional charge transport compounds suitable for use in the charge transport layer and photoconductors of the present invention should be capable of supporting the injection of photogenerated holes or electrons from the charge generation layer and allowing the transport of these holes or electrons to the charge transport layer surface to selectively discharge the surface charge. Suitable charge transport compounds for use in the charge transport layer include, but are not limited to, the following:

1. Pyrazoline transport molecules as disclosed in U.S. Pats. Nos. 4,315,982, 4,278,746 and 3,837,851.
2. Substituted fluorene charge transport molecules as described in U.S. Pat. No. 4,245,021.
3. Oxadiazole transport molecules such as 2,5-bis(4-diethylaminophenyl)-1,3,4-oxadiazole, imidazole, triazole, and others as described in German Patents Nos. 1,058,836, 1,060,260 and 1,120,875 and U.S. Pat. No. 3,895,944.
4. Hydrazone transport molecules including p-diethylaminobenzaldehyde-(diphenylhydrazone), p-diphenylaminobenzaldehyde-(diphenylhydrazone), o-ethoxy-p-diethylaminobenzaldehyde-(diphenylhydrazone), o-methyl-p-diethylarinobenzaldehyde-(diphenylhydrazone), o-methyl-p-dimethylaminobenzaldehyde (diphenylhydrazone), p-dipropylaminobenzaldehyde-(diphenylhydrazone), p-diethylaminobenzaldehyde- (benzylphenylhydrazone), p-dibutylaminobenzaldehyde-(diphenylhydrazone), p-dimethylaminobenzaldehyde-(diphenylhydrazone) and the like described, for example, in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example, in U.S. Pats. Nos. 4,385,106, 4,338,388, 4,387,147, 4,399,208 and 4,399,207. Yet other hydrazone charge transport molecules include carbazole phenyl hydrazones such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaidehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1, 1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426. Preferred hydrazone transport molecules include derivatives of aminobenzaldehydes, cinnamic esters or hydroxylated benzaidehydes. Exemplary amino benzaldehyde-derived hydrazones include those set forth in the Anderson et al U.S. Pats. Nos. 4,150,987 and 4,362,798, while exemplary cinnamic ester-derived hydrazones and hydroxylated benzaldehyde-derived hydrazones are set forth in the copending Levin et al U.S. applications Ser. Nos. 08/988,600 and 08/988,791, respectively, all of which patents and applications are incorporated herein by reference.

5. Diamine and triarylamine transport molecules of the types described in U.S. Pats. Nos. 4,306,008, 4,304,829, 4,233,384, 4,115,116, 4,299,897, 4,265,990 and/or 4,081,274. Typical diamine transport molecules include N,N'-diphenyl-N,N'-bis(alkylphenyl)-[1,1'-biphenyl]-4,4'-diamines wherein the alkyl is, for example, methyl, ethyl, propyl, n-butyl, or the like, or halogen substituted derivatives thereof, commonly referred to as benzidine and substituted benzidine compounds, and the like. Typical triarylamines include, for example, tritolylamine, and the like.

The charge transport layer will typically have a thickness of from about 10 to about 40 microns and may be formed in accordance with conventional techniques known in the art.

In one embodiment, the charge transport layer comprises a hydrazone charge transport compound and a binder, the charge generation layer comprises a phthalocyanine charge generation compound and the binder of the charge generation layer comprises from about 50 to about 99 weight percent polyvinylbutyral and from about 1 to about 50 weight percent polyhydroxystyrene. More preferably, the binder of the charge generation layer comprises from about 75 to about 99 weight percent polyvinylbutyral and from about 1 to about 25 weight percent polyhydroxystyrene; and most preferably from about 80 to about 99 weight percent polyvinylbutyral and from about 1 to about 20 weight percent polyhydroxystyrene.

In another embodiment, the charge transport layer comprises a benzidine charge transport compound and a binder, the charge generation layer comprises a phthalocyanine compound and the binder of the charge generation layer comprises from about 80 to about 99 weight percent polyvinylbutyral and from about 1 to about 20 weight percent polyhydroxystyrene. More preferably, the binder of the charge generation layer comprises from about 85 to about 99 weight percent polyvinylbutyral and from about 1 to about 15 weight percent polyhydroxystyrene.

In another preferred embodiment, the binder of the charge transport layer further comprises silicone microspheres as shown in U.S. Pat. No. 5,994,014, which is hereby incorporated in its entirety.

The following examples demonstrate various embodiments and advantages of the charge generation layers and photoconductors according to the present invention. In the examples and throughout the present specification, parts and percentages are by weight unless otherwise indicated.

EXAMPLE 1

In this Example, photoconductors according to the present invention and comparative photoconductors were prepared using charge generation layers according to the present invention and conventional charge generation layers, respectively. Each of the photoconductors described in this Example was prepared by dip-coating a charge generation layer dispersion on an aluminum substrate, followed by dip-coating a charge transport layer dispersion on the dried charge generation layer. In each of the photoconductors, the charge transport layer comprised about 30 weight percent N,N'-ditolyl-N,N'-diphenyl benzidine (TPD) in a bisphenol-A polycarbonate, formed from a solution as described in Table 1.

TABLE 1

| TPD Charge Transport Layer | |
|---|---|
| Transport Material | Relative Weight Percent |
| Bisphenol-A polycarbonate | 14.03 |
| Benzidine (TPD) | 6.01 |
| Tetrahydrofuran | 56.08 |
| 1,4-dioxane | 23.87 |

The charge generation layers of the respective photoconductors according to the invention in this Example comprised a charge generation compound and a binder, wherein the binder comprises polyvinylbutyral and a resin selected from the group consisting of polyhydroxystyrene and phenolic novolac. The charge generation compound selected for this Example was oxotitanium phthalocyanine. As will be apparent from Table 2, photoconductor 1A is a comparative photoconductor containing only polyvinylbutyral in the binder. Photoconductors 1B and 1C contain an additional resin, namely polyhydroxystyrene or phenolic novolac, in the binder according to the present invention. Specifically, photoconductor 1B contains polyhydroxystyrene with polyvinylbutyral in the binder of the charge generation layer of the photoconductor, while photoconductor 1C contained phenolic novolac and polyvinylbutyral in the binder of the charge generation layer of the photoconductor.

TABLE 2

| | Relative Weight Percent | | |
|---|---|---|---|
| CGL Disperson Component | 1A* | 1B | 1C |
| Oxotitanium Phthalocyanine | 1.8 | 1.8 | 1.8 |
| Polyvinylbutyral | 2.2 | 1.1 | 1.1 |
| Tetrahydrofuran | 28.67 | 28.67 | 28.67 |

TABLE 2-continued

| CGL Disperson Component | Relative Weight Percent | | |
|---|---|---|---|
| | 1A* | 1B | 1C |
| 2-butanone | 58.0 | 58.0 | 58.0 |
| Cyclohexanone | 9.33 | 9.33 | 9.33 |
| Polyhydroxystyrene | — | 1.1 | — |
| Phenolic novolac | — | — | 1.1 |

*comparative photoconductor

The charge generation dispersions described in Table 2 were coated on an anodized drum and dried at 100° C. for five minutes. The charge transport solution described in Table 1 was then coated over the respective charge generation layers and dried at 120° C. for 1 hour. Sensitivity measurements were made using an electrostatic sensitometer fitted with electrostatic probes to measure the voltage magnitude as a function of light energy shining on the photoconductive surface using an 820 nm laser. The drum was charged by a corona and the expose-to-develop time for all measurements was 76 milliseconds. The photosensitivity was measured as a discharge voltage on the photoconductor drum previously charged to about −850 V, measured at a light energy of 0.21 $\mu J/cm^2$ and 0.42 $\mu J/cm^2$. The dark decay of photoconductors 1A–1C. was also measured. Dark decay is the loss of charge on the surface of the photoconductor when it is maintained in the dark. Dark decay is an undesirable feature as it reduces the contrast potential between image and background areas, leading to washed-out images and loss of gray scale. A summary of the measured electrostatic properties is set forth in Table 3.

TABLE 3

| Photo-conductor | Charge (−V) | $-V_{0.21\ \mu J/cm2}$ | $-V_{0.42\ \mu J/cm2}$ | −Vr (residual) | Dark Decay (V/sec) |
|---|---|---|---|---|---|
| 1A* | −848 | −276 | −131 | −97 | 112 |
| 1B | −852 | −225 | −124 | −107 | 47 |
| 1C | −849 | −195 | −126 | −113 | 72 |

*comparative photoconductor

As shown in Table 3, the initial sensitivity of the photoconductor is improved when the charge generation binder is modified to contain a blend of the polyvinylbutyral and the resin (polyhydroxystyrene 1B or phenolic novolac 1C). In addition, the dark decay is significantly improved by the addition of the resin. For example, comparative photoconductor 1A has a dark decay of 112 V/sec, whereas photoconductor 1B shows a dark decay of only 47 V/sec.

EXAMPLE 2

In this Example, photoconductors according to the present invention and comparative photoconductors were prepared using charge generation layers according to the present invention and conventional charge generation layers, respectively. Each of the photoconductors described in this Example was prepared by dip-coating a charge generation layer solution on an aluminum substrate, followed by dip-coating a charge transport layer dispersion on the dried charge generation layer. In photoconductors 2A–2E, the charge transport layer comprised 30 weight percent of a TPD charge transport compound, prepared from the solution as shown in Table 1 of Example 1. In photoconductors 2F–2K, the charge transport layer comprised about 40 weight percent DEH charge transport compound, prepared from the solution as shown in Table 4.

TABLE 4

| Transport Material | Relative Weight Percent |
|---|---|
| bisphenol-A polycarbonate | 12.13 |
| DEH | 8.09 |
| tetrahydrofuran | 55.96 |
| 1,4-dioxane | 23.82 |

The charge generation layers of the respective photoconductors according to the invention in this Example comprised a charge generation compound and a binder, wherein the binder comprised polyvinylbutyral and polyhydroxystyrene. As described in Table 5, the charge generation compound comprised oxotitanium phthalocyanine (TiOPc). As will be apparent from Table 5, photoconductors 2A and 2K are comparative photoconductors, whereas photoconductors 2B–2J are photoconductors containing charge generation layers according to the present invention and comprise polyvinylbutyral and polyhydroxystyrene in the charge generation layer.

TABLE 5

| Dispersion Component | Relative Weight Percent | | | | | | | | | | |
|---|---|---|---|---|---|---|---|---|---|---|---|
| | 2A* | 2B | 2C | 2D | 2E | 2F | 2G | 2H | 2I | 2J | 2K* |
| polyvinylbutyral | 2.2 | 2.13 | 2.09 | 1.98 | 1.76 | 2.13 | 2.09 | 1.98 | 1.76 | 1.1 | 2.2 |
| 2-butanone | 86.67 | 86.67 | 86.67 | 86.67 | 86.67 | 86.67 | 86.67 | 86.67 | 86.67 | 86.67 | 86.67 |
| cyclohexanone | 9.33 | 9.33 | 9.33 | 9.33 | 9.33 | 9.33 | 9.33 | 9.33 | 9.33 | 9.33 | 9.33 |
| polyhydroxy-styrene | — | 0.066 | 0.11 | 0.22 | 0.44 | 0.066 | 0.11 | 0.22 | 0.44 | 1.1 | — |
| oxotitanium phthalocyanine | 1.8 | 1.8 | 1.8 | 1.8 | 1.8 | 1.8 | 1.8 | 1.8 | 1.8 | 1.8 | 18 |

*comparative photoconductor

The charge generation dispersions described in Table 5 were coated over an anodized aluminum drum and dried at 100° C. for five minutes. The charge transport dispersions described in Tables 1 and 4 were coated over the charge generation layers and dried at 120° C. for one hour. Photoconductors 2A–2E contained 30% benzidine charge transport compound in the charge transport layer while photoconductors 2F–2K contained 40% hydrazone charge transport compound in the charge transport layer.

Various electrostatic properties as described in Example 1 were measured. Table 6 depicts a summary of the electrostatic properties.

TABLE 6

| Photoconductor | $-V_{0.2\mu J/cm2}$ | $-V_{0.4\mu J/cm2}$ | Residual Voltage | Dark Decay (V/sec) |
|---|---|---|---|---|
| 2A* | −149 | −85 | −77 | 121 |
| 2B | −206 | −114 | −96 | 91 |
| 2C | −167 | −106 | −95 | 86 |
| 2D | −209 | −116 | −106 | 77 |
| 2E | −212 | −121 | −106 | 61 |
| 2F | −310 | −181 | −157 | 118 |
| 2G | −290 | −172 | −154 | 127 |
| 2H | −314 | −185 | −158 | 124 |
| 2I | −332 | −187 | −156 | 114 |
| 2J | −558 | −472 | −434 | 65 |
| 2K* | −292 | −157 | −134 | 121 |

*comparative photoconductor

As can be noted in Table 6, the addition of polyhydroxystyrene, even at low concentrations, lowers the dark decay of the photoconductors. For example, photoconductor 2B according to the present invention yields a dark decay of 91 V/sec, whereas the conventional photoconductor 2A yields a dark decay of 121 V/sec.

EXAMPLE 3

In this Example, photoconductors according to the present invention and comparative photoconductors were prepared using charge generation layers according to the present invention and conventional charge generation layers, respectively. Each of the photoconductors described in this Example was prepared by dip-coating a charge generation layer dispersion on an aluminum substrate followed by dip-coating a charge transport layer dispersion on the dried charge generation layer. In each of the photoconductors, the charge transport layer comprised about 30 weight percent of a TPD charge transport compound prepared from a dispersion as shown in Table 1.

The charge generation layers of the respective photoconductors according to this Example comprised a charge generation compound and polymeric binder. In each of the photoconductors 3A–3H, the charge generation compound comprised oxotitanium phthalocyanine at about 45 weight percent of the charge generation layer. As will be apparent from Table 7, photoconductors 3A, 3C, 3E and 3G are comparative photoconductors, whereas photoconductors 3B, 3D, 3F and 3H are photoconductors containing charge generation layers according to the present invention comprising polyvinylbutyral and polyhydroxystyrene in the charge generation layer. Photoconductors 3E–3H also comprised the addition of silicone microspheres (Tospearl from GE Silicones of New York) in the charge transport layer of the photoconductors.

TABLE 7

| Photoconductor | 3A* | 3B | 3C* | 3D | 3E* | 3F | 3G* | 3H |
|---|---|---|---|---|---|---|---|---|
| Charge Generation Layer Binder (polyvinylbutyral/polyhydroxystyrene) | 100/0 | 80/20 | 100/0 | 80/20 | 100/0 | 80/20 | 100/0 | 80/20 |
| Charge Transport Layer Binder (polycarbonate A/polycarbonate Z) | 100/0 | 100/0 | 75/25 | 75/25 | 100/0 | 100/0 | 75/25 | 72/25 |
| Tospearl in Charge Transport Layer | No | No | No | No | Yes | Yes | Yes | Yes |

*comparative photoconductor

Various electrostatic properties described in Example 1 were measured. Table 8 depicts a summary of the electrostatic properties.

TABLE 8

| Photoconductor | $V_{0.0\mu J/cm2}$ (initial/1K cycling) | $V_{0.23\mu J/cm2}$ (initial/1K cycling) | $V_{1.0\mu J/cm2}$ (initial/1K cycling) | Dark Decay (initial/1K cycling) |
|---|---|---|---|---|
| 3A* | −838/−832 | −154/−145 | −67/−62 | 71/167 |
| 3B | −845/−846 | −163/−185 | −73/−120 | 35/89 |
| 3C* | −853/−850 | −166/−141 | −92/−84 | 41/218 |
| 3D | −842/−843 | −116/−144 | −82/−118 | 32/61 |
| 3E* | −845/−836 | −132/−148 | −67/−95 | 77/162 |
| 3F | −854/−854 | −121/−193 | −71/−148 | 39/75 |
| 3G* | −854/−849 | −147/−175 | −85/−110 | 47/145 |
| 3H | −853/−854 | −125/−184 | −71/−127 | 38/71 |

*comparative photoconductor

As can be noted in Table 8, the addition of polyhydroxystyrene decreases the initial dark decay (i.e., photoconductor 3B as compared to photoconductor 3A). Furthermore, the dark decay change over 1,000 electric cycles is about 40 volts for photoconductors according to the present invention, whereas the dark decay change over 1,000 electric cycles is about 90 volts for a binder comprising only polyvinylbutyral in the charge generation layer.

EXAMPLE 4

In this Example, photoconductors according to the present invention and comparative photoconductors were prepared using charge generation layers according to the present invention and conventional charge generation layers, respectively. Each of the photoconductors described in this Example was prepared by dip-coating a charge generation layer dispersion on an aluminum substrate followed by dip-coating a charge transport layer solution on the dried charge transport layer. In each of the photoconductors, the charge transport layer comprised about 30 weight percent of a TPD charge transport compound prepared from a solution as shown in Table 1.

The charge generation layers of the respective photoconductors according to this Example comprise a charge generation compound and polymeric binder. In photoconductors 4A and 4E, the charge generation compound comprised oxotitanium phthalocyanine at about 45 weight percent of the charge generation layer. In photoconductors 4B–4D, the charge generation compound comprised oxotitanium phthalocyanine at about 35 weight percent of the charge generation layer. As will be apparent from Table 9, photoconductors 4A–4D are photoconductors containing charge generation layers according to the present invention and comprise polyvinylbutyral and polyhydroxystyrene. Photoconductor 4E is a photoconductor containing a charge generation layer according to the present invention comprising polyvinylbutyral and phenolic resol.

TABLE 9

| | Relative Weight Percent | | | | |
|---|---|---|---|---|---|
| Charge Generation Layer | 4A | 4B | 4C | 4D | 4E |
| Polyvinylbutyral | 27.5 | 32.5 | 61.75 | 58.5 | 27.5 |
| Polyhydroxystyrene | 27.5 | 32.5 | 3.25 | 6.5 | — |
| Oxotitanium phthalocyanine | 45 | 35 | 35 | 35 | 45 |
| Phenolic resol | — | — | — | — | 27.5 |

Various electrostatic properties described in Example 1 were measured. In addition, the photoconductors were evaluated to study electrical fatigue and print stability through the life of the cartridge. The evaluations of the systems were carried out on a Lexmark Optra S-2450 printer, using simplex mode. The WOB (white on black) and BOW (black on white) are measured on a gray scale page, wherein the page is divided into 128 boxes corresponding to various shades of gray, in ranges from an all-white to an all-black box, through 126 intermediate boxes. The change in the WOB and BOW corresponds to any fatigue involved with the drum. Table 10 depicts the summary of electrostatic properties.

TABLE 10

| Photoconductor | Prints EOL | Discharge 0K/0.5K/1K | Discharge EOL Hot/Cold | Isopel OD 0K/EOL | WOB 0K/EOL | All Black OD |
|---|---|---|---|---|---|---|
| 4A | 1K | −132/−60/−337 | — | 0.61/0.25 | 12/14 | 1.35/0.84 |
| 4B | 500 | −157/−431 | — | 0.44/0.07 | 13 | 1.41/0.43 |
| 4C | 20K | −79/−68/−69 | −71/−91 | 1.15/0.91 | 20/20 | 1.35/1.35 |
| 4D | 24.5K | −103/−90 | −158/−119 | 0.72/0.65 | 20/17 | 1.32/1.36 |
| 4E | 25.9K | −150/−137/−145 | −166/−159 | 0.58/0.47 | 16/14 | 1.41/1.32 |

WOB: White-on-Black
EOL: End of Life
Isopel OD: Isopel Optical Density
All Black OD: All Black Optical Density As can be noted in Table 10, the addition of polyhydroxystyrene at a concentration of 50% in the charge generation layer as demonstrated by photoconductors 4A and 4B, results in the photoconductor having severe negative fatigue due, in at least part, to the isopel optical density being reduced from 0.61 to 0.25 in the case of photoconductor 4A and 0.44 to 0.17 in the case of photoconductor 4B. This severe drop in the isopel OD occurs as early as 500–1000 prints, and the prints appear washed out However, at lower polyhydroxystyrene concentrations, such as photoconductors 4C and 4D, the photoconductors are relatively stable and exhibit only slight negative fatigue. Additionally, the gray scale resolution is improved through the life of the drum.

A relatively stable drum will not exhibit a difference in electricals between "hot" and "cold" operating conditions. The hot and cold refers to the temperature in the printer. "Hot" signifies a printer that is continuously running and has a temperature build up and is usually at about 45–50° C. "Cold" indicates a printer and cartridge that had an overnight rest, and electricals are measured at the start of the printing. As can be noted from Table 10, photoconductor 4E containing phenolic resol exhibited the smallest variation between hot and cold, thereby signifying better stability of the photoconductor.

EXAMPLE 5

In this Example, photoconductors according to the present invention were prepared using charge generation layers according to the present invention. Each of the photoconductors described in this Example was prepared by dip-coating a charge generation layer solution on an aluminum substrate followed by dip-coating a charge transport layer dispersion on the dried charge generation layer. In each of the photoconductors, the charge transport layer comprises about 40 weight percent of a DEH charge transport compound prepared from a dispersion as shown in Table 4.

The charge generation layers of the respective photoconductors according to this Example comprise a charge generation compound and polymeric binder. In each of the photoconductors 5A and 5B, the charge generation compound comprised an oxotitanium phthalocyanine at about 35 weight percent of the charge generation layer. As will be apparent from Table 11, photoconductors 5A and 5B are photoconductors containing charge generation layers according to the present invention comprising polyvinylbutyral and polyhydroxystyrene in the charge generation layer.

Various electrostatic properties described in Example 4 were measured. Table 11 depicts a summary of the electrostatic properties.

TABLE 11

| Photoconductor | Prints EOL | Discharge 0K/1K | Discharge EOL Hot/Cold | Isopel OD 0K/EOL | WOB 0K/20K/EOL | All Black OD |
|---|---|---|---|---|---|---|
| $5A_1$ | 20.9K | −113/−111 | −114/−126 | 0.81/0.82 | 17/16/16 | 1.35/1.35 |
| $5B_2$ | 20K | −147/−128 | −120/−140 | 0.93/0.59 cold<br>0.93/0.67 hot | 15/15 | 1.38/1.34 |

[1]Charge Generation Layer Binder = 90% polycarbonate Z, 10% polyhydroxystyrene
[2]Charge Generation Layer Binder = 80% polycarbonate Z, 20% polyhydroxystyrene As can be noted in Table 11, the addition of polyhydroxystyrene in photoconductors 5A and 5B along with a DEH transport compound results in stable print performance through the life of the photoconductors. Some variation in the hot-to-cold discharge of the photoconductor was noted at end of life. Over all, photoconductors 5A and 5B resulted in stable performance.

Thus, these Examples demonstrate that the photoconductors according to the present invention exhibit good electrical characteristics. The various preferred embodiments and examples set forth herein are presented to further illustrate the claimed invention and are not intended to be limiting thereof. Additional embodiments and alternatives within the scope of the claimed invention will be apparent to those of ordinary skill in the art.

What is claimed is:

1. A photoconductor comprising an electrically conductive substrate, a charge generation layer and a charge transport layer, wherein the charge generation layer comprises a binder and a phthalocyanine charge generation compound, and further wherein the binder comprises polyvinylbutyral and a phenolic novolac resin, the resin being included in an amount which improves at least one electrical characteristic of the photoconductor.

2. The photoconductor of claim 1, wherein the phthalocyanine charge generation layer comprises an oxotitanium phthalocyanine compound.

3. The photoconductor of claim 1, wherein the charge transport layer comprises a binder and a charge transport compound.

4. The photoconductor of claim 3, wherein the charge transport compound comprises a benzidine charge transport compound.

5. The photoconductor of claim 3, wherein the charge transport compound comprises a hydrazone charge transport compound.

6. The photoconductor of claim 3, wherein the binder of the charge transport layer comprises bisphenol-A polycarbonate, bisphenol-Z polycarbonate, or mixtures thereof.

7. The photoconductor of claim 5, wherein the binder comprises from about 50 to about 99 weight percent polyvinylbutyral and from about 1 to about 50 weight percent phenolic novolac resin.

8. The photoconductor of claim 4, wherein the binder comprises from about 50 to about 99 weight percent polyvinylbutyral and from about 1 to about 50 weight percent phenolic novolac resin.

9. A charge generation layer comprising a binder and a charge generation compound, wherein the binder comprises polyvinylbutyral and phenolic resol.

10. The charge generation layer of claim 9, wherein the charge generation compound comprises a phthalocyanine compound.

11. The charge generation layer of claim 9, wherein the charge generation compound comprises an oxotitanium phthalocyanine compound.

12. The charge generation layer of claim 9, wherein the charge generation compound comprises a squarylium pigment.

13. The charge generation layer of claim 9, wherein the charge generation compound comprises a hydroxy-substituted squarylium pigment.

14. The charge generation layer of claim 9, wherein the phenolic resol has a molecular weight average of at least about 500.

15. The charge generation layer of claim 9, wherein the binder comprises the polyvinylbutyral and the phenolic resol in a weight ratio of from about 90:10 to about 10:90.

16. The charge generation layer of claim 9, wherein the binder comprises the polyvinylbutyral and the phenolic resol in a weight ratio of from about 90:10 to about 50:50.

17. A photoconductor comprising an electrically conductive substrate, a charge generation layer and a charge transport layer, wherein the charge generation layer comprises a binder and a charge generation compound, and further wherein the binder comprises polyvinylbutyral and phenolic resol.

18. The photoconductor of claim 17, wherein the charge generation compound comprises a phthalocyanine compound.

19. The photoconductor of claim 18, wherein the charge generation compound comprises an oxotitanium phthalocyanine compound.

20. The photoconductor of claim 17, wherein the charge generation compound comprises a squarylium pigment.

21. The photoconductor of claim 17, wherein the charge generation layer is situated between the charge transport layer and the substrate.

22. The photoconductor of claim 17, wherein the charge transport layer is situated between the charge generation layer and the substrate.

23. The photoconductor of claim 17, wherein the charge transport layer comprises a binder and a charge transport compound.

24. The photoconductor of claim 23, wherein the charge transport compound comprises a triarylamine charge transport compound.

25. The photoconductor of claim 23, wherein the charge transport compound comprises a hydrazone charge transport compound.

26. The photoconductor of claim 23, wherein the binder of the charge transport layer comprises bisphenol-A polycarbonate, bisphenol-Z polycarbonate, or mixtures thereof.

27. The photoconductor of claim 26, wherein the binder of the charge transport layer further comprises silicone microspheres.

28. A photoconductor comprising an electrically conductive substrate, a charge generation layer and a charge transport layer, wherein the charge generation layer comprises a binder and a phthalocyanine charge generation compound, and further wherein the binder comprises polyvinylbutyral and polyhydroxystyrene, the polyhydroxystyrene being included in an amount which improves at least one electrical characteristic of the photoconductor.

29. The photoconductor of claim 28, wherein the phthalocyanine charge generation layer comprises an oxotitanium phthalocyanine compound.

30. The photoconductor of claim 28, wherein the charge transport layer comprises a binder and a charge transport compound.

31. The photoconductor of claim 30, wherein the charge transport compound comprises a benzidine charge transport compound.

32. The photoconductor of claim 30, wherein the charge transport compound comprises a hydrazone charge transport compound.

33. The photoconductor of claim 30, wherein the binder of the charge transport layer comprises bisphenol-A polycarbonate, bisphenol-Z polycarbonate, or mixtures thereof.

34. The photoconductor of claim 32, wherein the binder comprises from about 80 to about 99 weight percent polyvinylbutyral and from about 1 to about 20 weight percent polyhydroxystyrene.

35. The photoconductor of claim 31, wherein the binder comprises from about 90 to about 99 weight percent polyvinylbutyral and from about 1 to about 10 weight percent polyhydroxystyrene.

* * * * *